United States Patent [19]

Arzoumanian

[11] 4,114,532

[45] Sep. 19, 1978

[54] IMPACT PRINTER MAGNET ASSEMBLY

[75] Inventor: Aram Sarkis Arzoumanian, Encino, Calif.

[73] Assignee: Dataproducts Corporation, Woodland Hills, Calif.

[21] Appl. No.: 731,694

[22] Filed: Oct. 12, 1976

[51] Int. Cl.[2] ..... B41J 9/02

[52] U.S. Cl. ..... 101/93.48; 335/296; 335/306; 335/302

[58] Field of Search ..... 101/93.29, 93.30, 93.31, 101/93.32, 93.33, 93.34, 93.48; 335/229, 296, 302, 306; 197/1 R

[56] References Cited

U.S. PATENT DOCUMENTS

| | | | |
|---|---|---|---|
| 3,204,155 | 8/1965 | Charpentier | 335/296 |
| 3,285,166 | 11/1966 | Helms et al. | 101/93.34 |
| 3,513,422 | 5/1970 | Watson et al. | 335/296 |
| 3,755,706 | 8/1973 | Scott | 335/296 X |
| 3,818,399 | 6/1974 | Edwards | 335/306 X |
| 3,889,220 | 6/1975 | Spodig | 335/306 |
| 3,983,806 | 10/1976 | Ishi | 101/93.48 |

*Primary Examiner*—Edward M. Coven
*Attorney, Agent, or Firm*—Lindenberg, Freilich, Hornbaker, Wasserman, Rosen & Fernandez

[57] ABSTRACT

A magnet assembly is disclosed suitable for use in an impact printer to produce a magnetic field for propelling movably mounted hammer coils toward a type bearing surface. The magnet assembly is comprised of a plurality of spaced relatively thin substantially rectangular magnetic members mounted along first and second parallel rows. End bridging bars are provided which, together with the members, form a closed magnetic field path in which the flux lines extend through the thin dimension of the members in one direction in the first row and in an opposite direction in the second row. The members in the first and second rows are aligned so as to define aligned gaps, each pair of aligned gaps receiving a flat hammer coil. In one embodiment, all of the magnetic members are permanent magnets in which rare earth and Alnico type magnets are interleaved. In a second embodiment, rare earth magnets are interleaved with members of soft iron.

9 Claims, 7 Drawing Figures

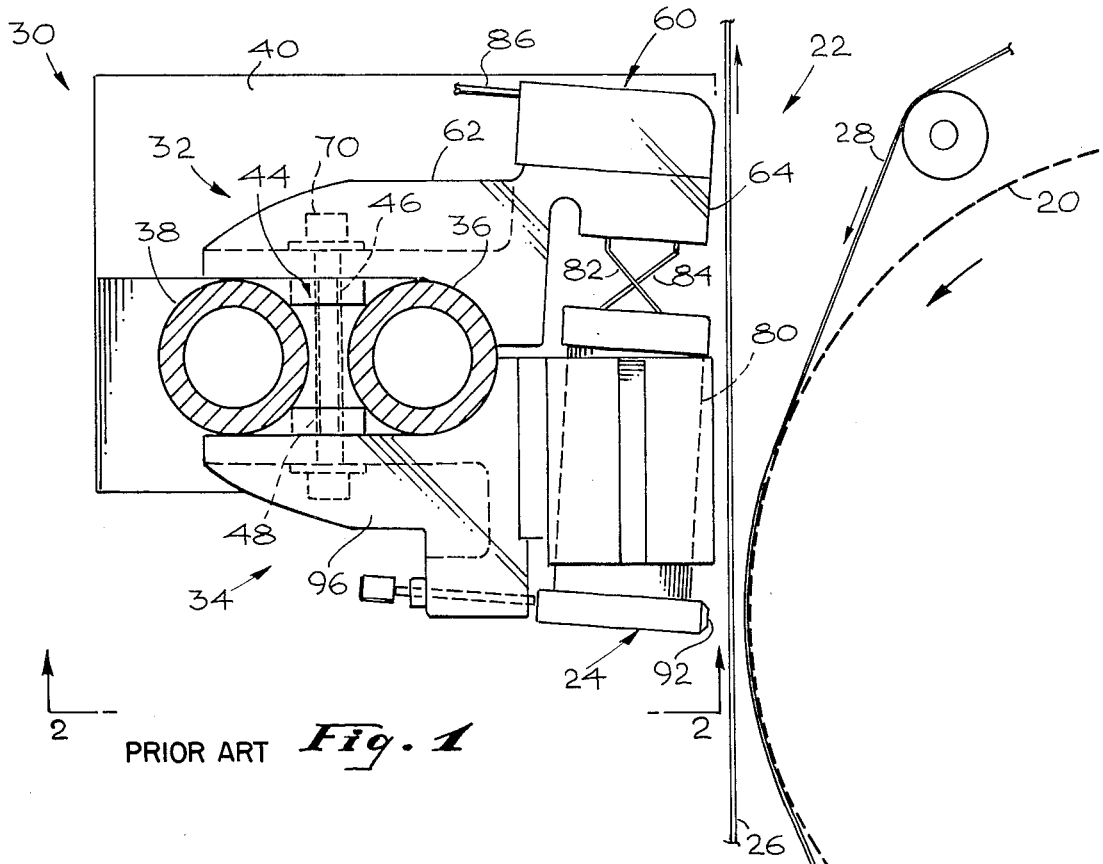
PRIOR ART *Fig. 1*
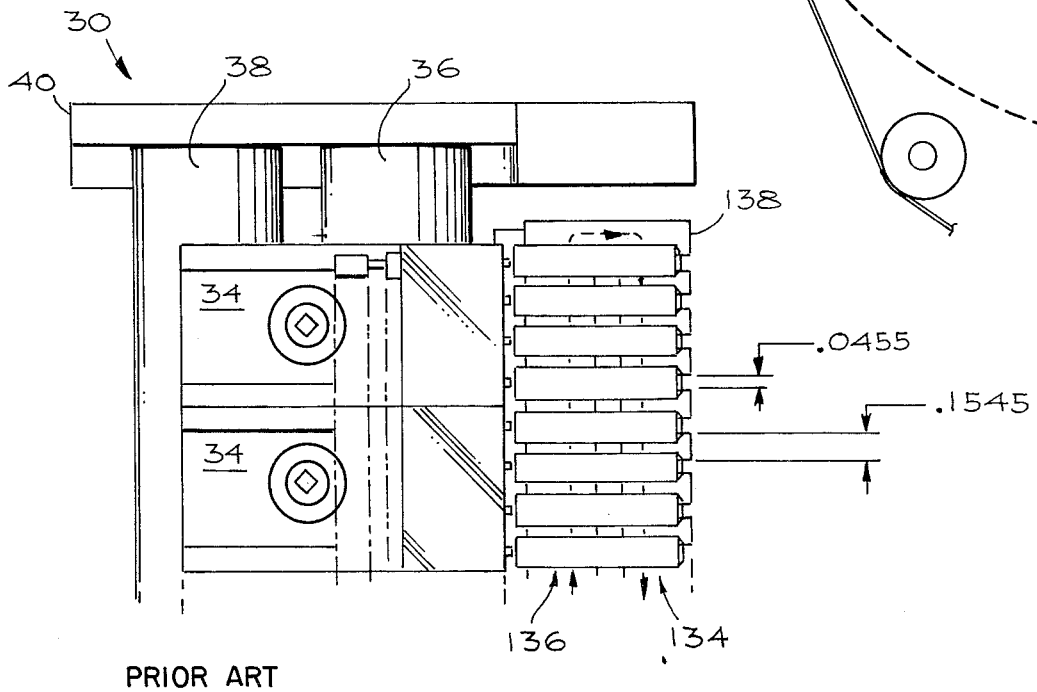
PRIOR ART
*Fig. 2*

IMPACT PRINTER MAGNET ASSEMBLY

BACKGROUND OF THE INVENTION

The present invention relates generally to magnet assemblies suitable for use in impact printers of the type utilizing moving coil hammers. Several United States patents have issued disclosing this type of impact printer. For example only, attention is called to: U.S. Pat. Nos. 3,087,421, 3,172,352, 3,279,362, 3,285,166, and 3,643,595.

In all of the printers disclosed in the foregoing patents, a permanent magnet assembly is provided which defines a plurality of gaps, each of which receives a flat coil which is physically coupled to a hammer for impacting against a type bearing surface. In at least some of the foregoing patents, the magnet assembly is comprised of a plurality of permanent magnet members arranged in first and second parallel rows and poled so as to create a closed magnetic field path in which the flux is oriented in one direction in the first row and in an opposite direction in the second row. Gaps in the first and second rows are aligned such that each pair of aligned gaps receives a different hammer coil. A current driven through the coil produces a force on the coil which propels the hammer toward the type bearing surface, which may comprise a moving drum or band.

The force developed on the coil is proportional to the product of the flux density (B) within the gap and the current through the coil (i). As a practical matter, the magnitude of the coil current (i) should be minimized to avoid heating problems. Thus, for a given value of coil current, the force developed on the hammer will be related directly to the magnitude of flux density within the gap. For a given geometry of certain dimensions, the flux density is dependent primarily upon the permanent magnet material selected. Generally speaking, higher energy materials, such as rare earth materials, are considerably more costly than lower energy materials such as Alnico.

SUMMARY OF THE INVENTION

The present invention is directed to an improved magnet assembly which yields high gap flux density relatively inexpensively. An assembly in accordance with the invention makes use of a type of permanent magnet composed of rare earth alloys. Such alloys have come into prominence in recent years because of the very high energy product they yield. Such alloys are now reasonably well-known in the technical and patent literature, e.g. see U.S. Pat. No. 3,970,484.

In accordance with a preferred embodiment of the invention, a magnet assembly is provided comprised of magnetic members of high-energy rare earth magnet material interleaved with members of lower energy magnet material such as Alnico. Properly configured, the resulting structure yields a gap flux density which is higher than the average of the flux density which would be yielded by an assembly comprised of all rare earth or all Alnico magnets.

In an alternate embodiment of the invention, the high-energy rare earth magnets are interleaved with pieces of soft iron, in lieu of Alnico magnets.

The novel features of the invention are set forth with particularity in the appended claims. The invention will best be understood from the following description when read in conjunction with the accompanying drawings.

BRIEF DESCRIPTION OF THE DRAWINGS

FIG. 1 is a sectional view through a prior art impact printer of the type using moving coil hammers in which the teachings of the present invention can be advantageously employed;

FIG. 2 is a sectional view taken substantially along the plane 2—2 of FIG. 1;

DESCRIPTION OF THE PREFERRED EMBODIENTS

Figure 3:
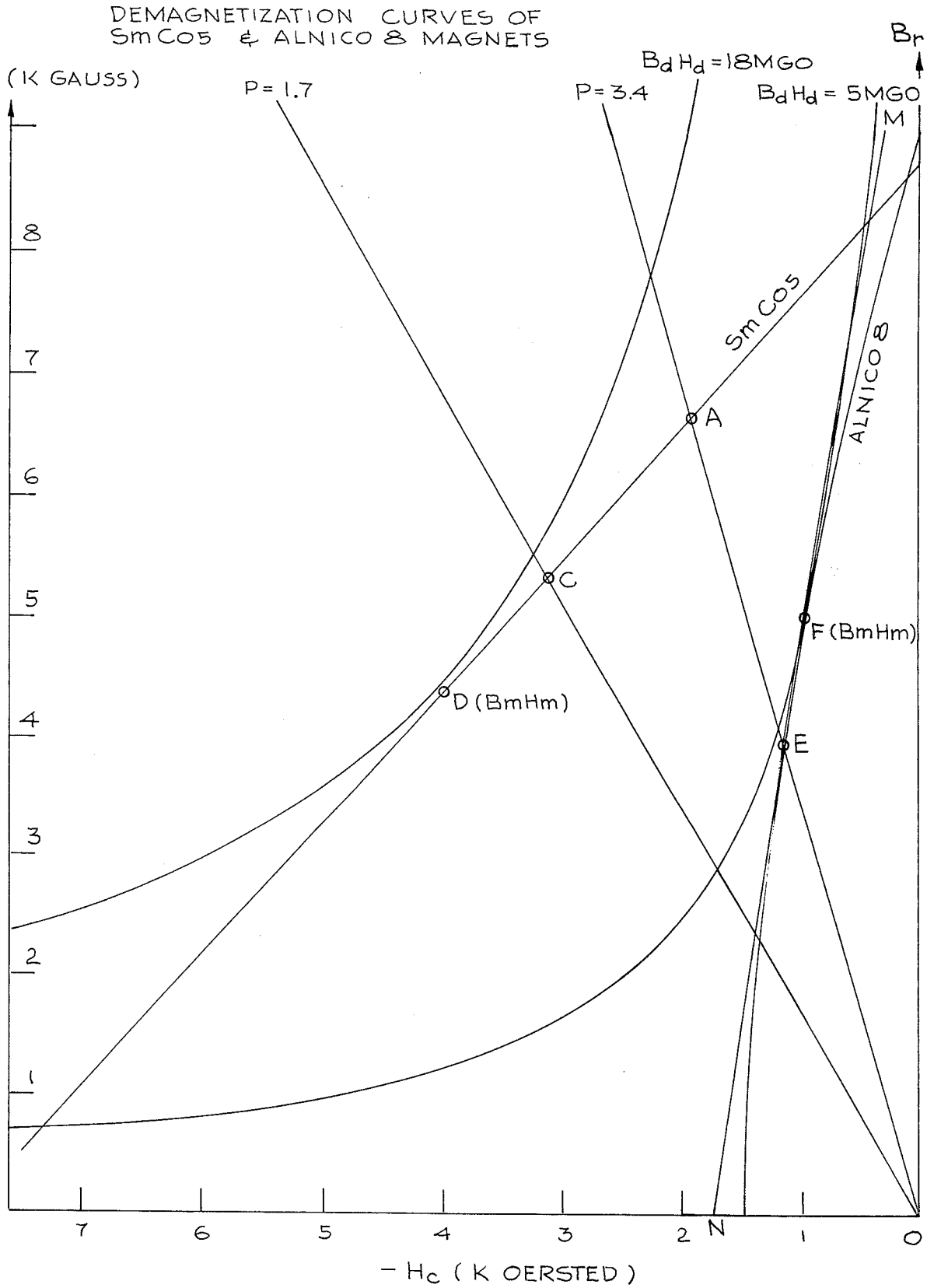
FIG. 3 is a graph primarily illustrating the demagnetization curves of one of the rare earth magnet materials (samarium cobalt) and of Alnico 8 magnet material.

Attention is now called to FIGS. 1 and 2 which illustrate a typical high-speed impact printer, as for example of the type disclosed in greater detail in U.S. Pat. No. 3,983,806 issued Oct. 5, 1976 to George Ishii and assigned to the same assignee as the present application. Briefly, the printer of FIGS. 1 and 2 is comprised of a moving type bearing surface, such as a drum 20 having raised characters (not shown) formed on the peripheral surface thereof arranged in rows extending parallel to the drum axis and rings extending around the drum axis. A hammer bank assembly 22 comprised of a plurality of individually actuatable hammers 24 is mounted adjacent to the drum 20. The hammer bank assembly is spaced from the drum 20 to permit the paper 26 to be printed upon, and an ink ribbon 28 to be passed therebetween. A paper stepping system, not shown, is typically provided to step the paper 26 one line at a time past the hammers 24. By actuating a hammer at the appropriate time relative to the drum position, the hammer will impact the rear surface of paper 26, forcing the paper front surface against the ribbon 28 abd selected character on drum 20 to print the character on the front surface of the paper.

The hammer bank assembly 22 is typically comprised of a mounting structure 30 and a plurality of hammer modules 32 and magnet modules 34 supported on the mounting structure. The mounting structure may consist of first and second elongated tubular members 36 and 38 secured in parallel relationship between a pair of end plates 40. The tubular members 36 and 38 carry plurality of fastening members 44 along the length thereof, each fastening member constituting a substantially hourglass shaped insert for fitting between the tubular members 36 and 38 so as to engage and be retained against the circumferential surface thereof. Each fastening member 44 includes oppositely extending bores 46 and 48 which are internally threaded for receiving bolts for fastening hammer modules 32 and magnet modules 34 thereto. The mounting structure may be shuttled back and forth between first and second print positions as is explained in U.S. Pat. No. 3,911,814.

Each hammer module 32 is comprised of a common foot member 60 which generally includes a rear base portion 62 which locates and secures the module to the mounting structure elongated member 36 and a forwardly projecting portion 64 which supports a multiple number of hammers 24.

The rear base portion 62 of the foot member 60 includes a recess of arcuate cross section dimensioned so as to conform to the outer surface of the mounting structure eleongated memeber 36. The hammer module foot member 60 is provided with a bolt hole extending therethrough for receiving a bolt 70 which threads into the internally threaded bore 46 of a fastening member 44.

Each of the hammer modules 32 further includes a multiple number of hammers 24, each spring mounted on the forwardly projecting portion 64 of foot member 60. As is disclosed in the aforementioned U.S. Pat. No. 3,279,362, each of the hammers is comprised of a rigid structure 80 comprised of a multiturn conductive coil (not shown) mounted within a flat rigid housing, of aluminum, for example. The coil structure 80 is mounted for rotation on a pair of conductive springs 82 and 84, whose ends remote from the coil structure 80 are secured in the forwardly projecting portion 64 of the foot member 60. The springs 82 and 84 are electrically conductive for carrying current to the coil within the coil structure 80. A multi-wire cable 86 is provided for coupling a connector to the multiple hammers of each hammer module 32. The ends of the coil (not shown) are electrically connected to the springs 82 and 84. An impact tip 92 is carried on the end of the coil structure 80 remote from the springs 82 and 84.

The plurality of hammer modules are mounted on the elongated member 36 in alignment, located by the engagement of the member 36 within the arcuate recess in the hammer module foot members and by the engagement of the bolts 70 extending through the hammer module foot members into the fastening members 44. Positioned in this manner, the front ends of all the impact tips 92 lie along a common horizontal line extending parallel to the axis of the character drum 20 of FIG. 1.

In order to develop a force on the coil structure 80 of a hammer 24 to propel the hammer tip 92 against the drum 20 when the coil is energized, a magnetic field is developed by the previously-mentioned magnet modules 34 which extends perpendicular to the planes of the coil structures 80. Each magnet module is comprised of a foot member 96 located and retained on the mounting structure member 36 in essentially the same manner as has been described in connnection with the hammer assemblies 32. Projecting forwardly from the magnet module foot member 96 are a plurality of thin rectangular magnetic members which are spaced parallel to one another and which, as will be discussed hereinafter, may be comprised of permanent magnet or soft iron material.

In a typical printer of the type illustrated in FIGS. 1 and 2, a plurality, e.g. 68, of aligned hammers 24 are mounted along the tubular member 36 in order to print at an equal number of columnar positions along a line. The magnet assembly comprised of multiple magnet modules each carrying multiple magnets provides a number of gaps equal to the number of hammers provided such that each gap is dedicated to a particular hammer. The spacing between hammers is typically 0.2 inches. The thickness of a hammer typically requires that each gap have a minimum length of 0.0455 inches, leaving a maximum length dimension of 0.1545 inches for each magnet piece. The magnets are arranged, as depicted in FIG. 2, along first and second parallel rows 134, 136 with the magnets in each row spaced from one another to define the gaps therebetween. The gaps of the respective first and second rows are aligned and each gap pair is thus able to receive a common hammer coil. The magnets are oriented with their pole faces adjacent the gaps and to produce flux along said first and second rows in opposite directions. Magnetic bridging bars 138 are coupled to adjacent ends of the first and second rows of magnets to thus create a closed flux path extending through the first and second rows and bridging bars. Prior magnet assemblies structured and dimensioned as depicted in FIG. 2 have generally utilized identical magnet pieces, generally formed of Alnico 8 material, for example, which produces a gap flux density on the order of 4,000 gauss.

The present invention is directed to an improved magnet assembly and will be disclosed in an embodiment assumed to be structured and dimensioned as depicted in FIG. 2. One of the objects in designing a magnet assembly is to achieve a sufficiently high gap flux density at a relatively low cost. Since the cost is directly related to the volume of magnet material required, costs can be minimized by operating the magnets as close as possible to the maximum energy product point on the magnet's demagnetization curve.

Attention is now called to FIG. 3 which illustrates the demagnetization curves of a typical aluminum-nickel-cobalt alloy (Alnico8) and a typical rare earth (re) alloy, samarium cobalt ($S_mC_{o5}$). As is well known, the characteristics of a permanent magnet are most frequently presented in terms of its demagnetization curve which comprises the second quadrant of its hysteresis loop. The key characteristics of a permanent magnet material, all of which can be determined from its demagnetization curve, are:

Residual Flux Density $B_r$ in gauss; i.e. the magnetic flux density corresponding to zero magnetizing force (H) in a magnetic material which is in a symmetrically, cyclically magnetized condition.

Coercive Force $H_c$ in oersteds; i.e. the magnetizing force that must be applied to a magnetic material in a direction opposite to the residual flux density $B_r$ to reduce the flux density to zero.

Energy Product in Gausss-Oersteds; i.e. the external energy produced by a magnet which is the product of the flux density B and demagnetizing force H as shown on the normal demagnetization curve. The maximum of this energy product ($B_mH_m$) is the point at which the minimum volume of magnet material is required.

Permanent magnets composed of cobalt and rare earth alloys such as samarium cobalt ($S_mC_{o5}$) typically exhibit maximum energy products in excess of 12 million gauss oersted and materials of this energy product level will be assumed herein when reference is made to a rare earth magnet.

A permanent magnet can be caused to operate at any particular point on its demagnetization curve dependent upon the characteristics of the external magnetic circuit. The significant characteristics of an operating point on the demagnetization curve are:

Permeance coefficient (P); i.e. the ratio of the total external permeance to that of the permeance of the space occupied by the magnet ($P = B_d/H_d$).

Incremental Permeability ($\mu\Delta$); i.e. the ratio of cyclic change in flux density B to the cyclic change in magnetizing force H from any point on the hysteresis loop ($\mu_\Delta = B\Delta/H\Delta$).

In addition to the demagnetization curves for Alnico 8 and samarium cobalt, FIG. 3 also illustrates two hyperbolic curves respectively representing energy products of 5 and 18 million gauss-oersteds, and two load lines representing permeance coefficients of 3.4 and 1.7. The load line of permeance coefficient 3.4 is representative of a fixed gap circuit in which the ratio of magnet length to gap length is 3.4, e.g. as depicted in FIG. 2 where magnet length ($L_m$) equals 0.1545 inches and gap length ($L_g$) equals 0.0455 inches. FIG. 3 also depicts a line MEN which is tangent to the Alnico 8 demagnetization curve at point E.

It will be noted from FIG. 3 that the load line P=3.4 for the configuration depicted in FIG. 2 cuts the Alnico 8 demagnetization curve at a working point E where $B_d$ equals 4,000 gauss, $H_d$ equals 1,170 oersteds, and the energy product $B_dH_d$ equals 4.7 million gauss-oersteds (MGO). This energy product value is equal to 94% of the maximum energy product of $B_mH_m$ which occurs at point F where $B_m$ equals 5,000 gauss and $H_m$ equals 1,000 oersteds and $B_mH_m$ equals 5.0 MGO.

The same load line of P=3.4 cuts the samarium cobalt demagnetization curve at a working point A where $B_d$ = 6650 gauss, $H_d$ = 1950 oersteds and the energy product $B_dH_d$ = 13.0 MGO. This energy product is equal to 74% of the maximum energy product $B_mH_m$ which occurs at point D where $B_m$ = 4400 gauss and $H_m$ = 4000 oersteds and $B_mH_m$ = 17.6 MGO.

Utilization of the Alnico 8 magnets in the geometric configuration depicted in FIG. 2 and represented by the load line P = 3.4 in FIG. 3 represents a reasonably efficient utilization of magnet material since the resulting energy product is 94% of maximum. However, the resultant flux density B of 4000 gauss is low compared to the utilization of samarium cobalt in the same configuration. However, utilization of samarium cobalt magnets in that configuration represents a relatively inefficient utilization of magnet material, since the resulting energy product is only 74% of maximum.

The present invention is directed to an improved magnet assembly which utilizes a combination of materials having different characteristics to efficiently yield high gap flux density.

Figure 4:
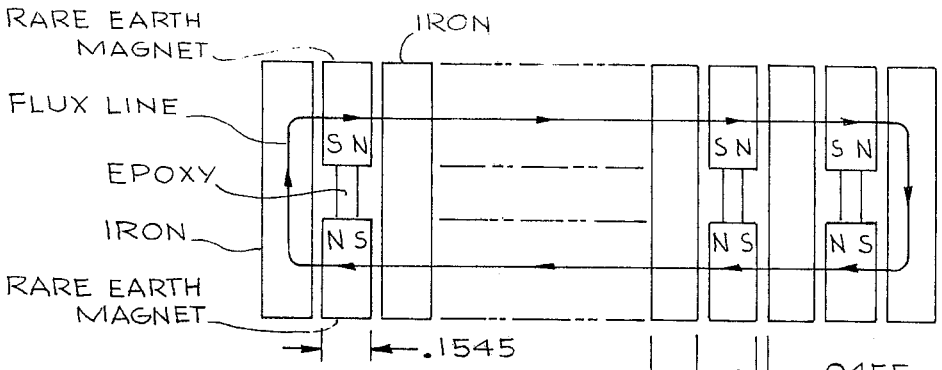
FIG. 4 is a schematic diagram illustrating a first embodiment of the present invention.

In the first embodiment of the invention depicted in FIG. 4, in order to raise the energy product of the rare earth samarium cobalt magnet working point closer to its maximum $B_mH_m$ (while maintaining the same design dimensions depicted in FIG. 2), a magnetic circuit is formed in which samarium cobalt magnet pieces and soft iron pieces are alternated. In evaluating the resulting structure depicted in FIG. 4, and ignoring the very low value of magnetic reluctance of the iron, it will be recognized that each magnet piece serves two gaps, each having a length dimension of 0.0455 inches. Therefore, the permeance coeifficient of the magnetic circuit becomes P = 0.1545/2 (0.0455) = 1.7 which defines a working point C (FIG. 3) where $B_d$ = 5350 gauss, $H_d$ = 3150 oersteds and $B_dH_d$ = 16.9 MGO. This energy product value is 96% of the maximum energy product of 17.6 MGO represented at point D.

Thus, it can be seen that the embodiment of FIG. 4 utilizing interlaced samarium cobalt magnet pieces and soft iron pieces yields a higher gap flux density than that of a correspondingly dimensioned magnet assembly formed of Alnico 8 magnets. The increased flux density is achieved while also achieving an improved utilization of magnet material since the ratio of the operating energy product to the maximum energy product is increased.

Figure 5:
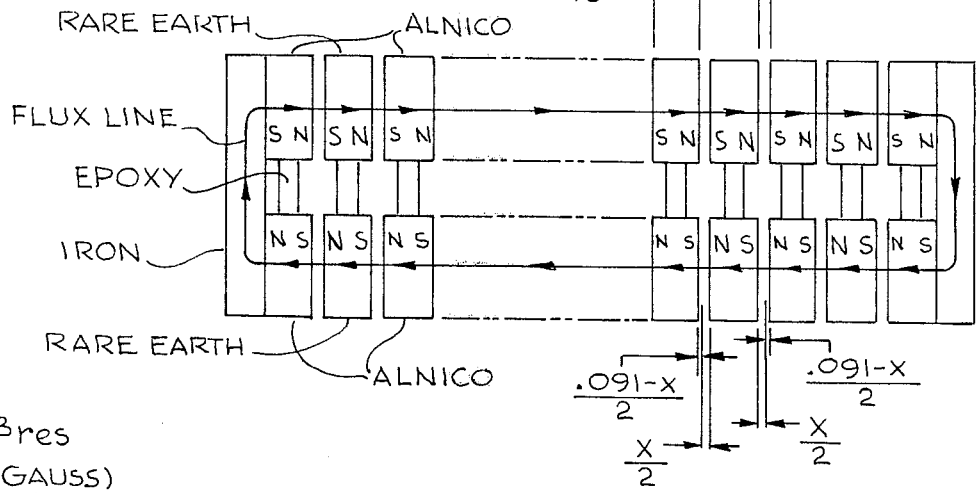
FIG. 5 is a schematic diagram similar to FIG. 4, but illustrating a preferred embodiment of the invention.

Attention is now called to FIG. 5 which illustrates an alternative and preferable embodiment of the invention in which high energy magnets such as rare earth magnets of samarium cobalt material are interlaced with lower cost magnets of Alnico 8 material. As will be developed hereinafter, the resulting magnetic circuit yields higher flux density than the average of these magnets used separately in the same configuration.

In the embodiment of FIG. 4 in which the magnet assembly is comprised of high energy samarium cobalt magnets and soft iron pieces, the gaps are of course all energized by the samarium cobalt magnets. However, in the embodiment of FIG. 5 in which a combination of samarium cobalt and Alnico magnets are utilized, the flux density in the gaps is attributable to both the samarium cobalt and the Alnico magnets. In order to quantitatively evaluate the magnet circuit of FIG. 5, let the gap length energized by each samarium cobalt magnet be represented by $x$ and the gap length energized by each Alnico magnet be represented by $2(0.0455)-x$.

Writing the equation of the rare earth and Alnico demagnetization curves in the form of $B = f(H;x)$ (where $H = B/P$) and equalizing them, we come up with a value for $x$ allowing us to calculate the flux density B. In this case, the permeance coefficient of the rare earth magnet will be: $P_{re} = 0.1545/x$ and the permeance coefficient of the Alnico magnet will be: $P_{A1} = 0.1545/0.091-x$.

The rare earth demagnetization curve being a straight line with an incremental permeability of $\mu_{\Delta re} = Br/Hc = 8.8/8 = 1.1$ (see FIG. 3) its equation is: $B = 1.1H + 8.8$, but $P_{re} = B/=H = Lm/Lg_{re} = 0.1545/x$ which gives us: $H = -(Bx/0.1545)$. Replacing H by its value:

$$B = -1.1\,(Bx/0.1545) + 8.8 \text{ and } B_{re} = 8.8/1+7.12x \quad (1)$$

The Alnico 8 demagnetization curve can be approximated by taking the incremental permeability at the working point (in our case point E) where $\mu_{\Delta A18} = Br/Hc = 12.25/1.75 = 7$ and writing a straight line equation: $B = 7H + 12.25$, but $P_{A18} = B/-H = Lm/Lg_{A18} = 0.1545/0.091-x$ which give us: $H = -B(0.091-x)/0.1545$. Replacing H by its value: $B = -7B\ (0.091-x/0.1545) + 12.25$ and $B_{A18} = 12.25/1+45.25(0.091-x)$ (2)

Equalizing $B_{re}$ and $B_{A18}$ we have:

$$8.8/1+7.12x = 12.25/[1+45.25(0.091-x)] \text{ and } x = 0.0675 \text{ inch.}$$

Replacing $x$ by its value in (1) we have:

$$B_{re} = 8.8/[1+(7.12x0.0675)];\ B_{re} = 5940 \text{ gauss.}$$

Replacing $x$ by its value in (2) we have:

$$B_{A18} = 12.25/[1+45.25(0.091-0.0675)];\ B_{A18} = 5940 \text{ gauss.}$$

Figure 6:
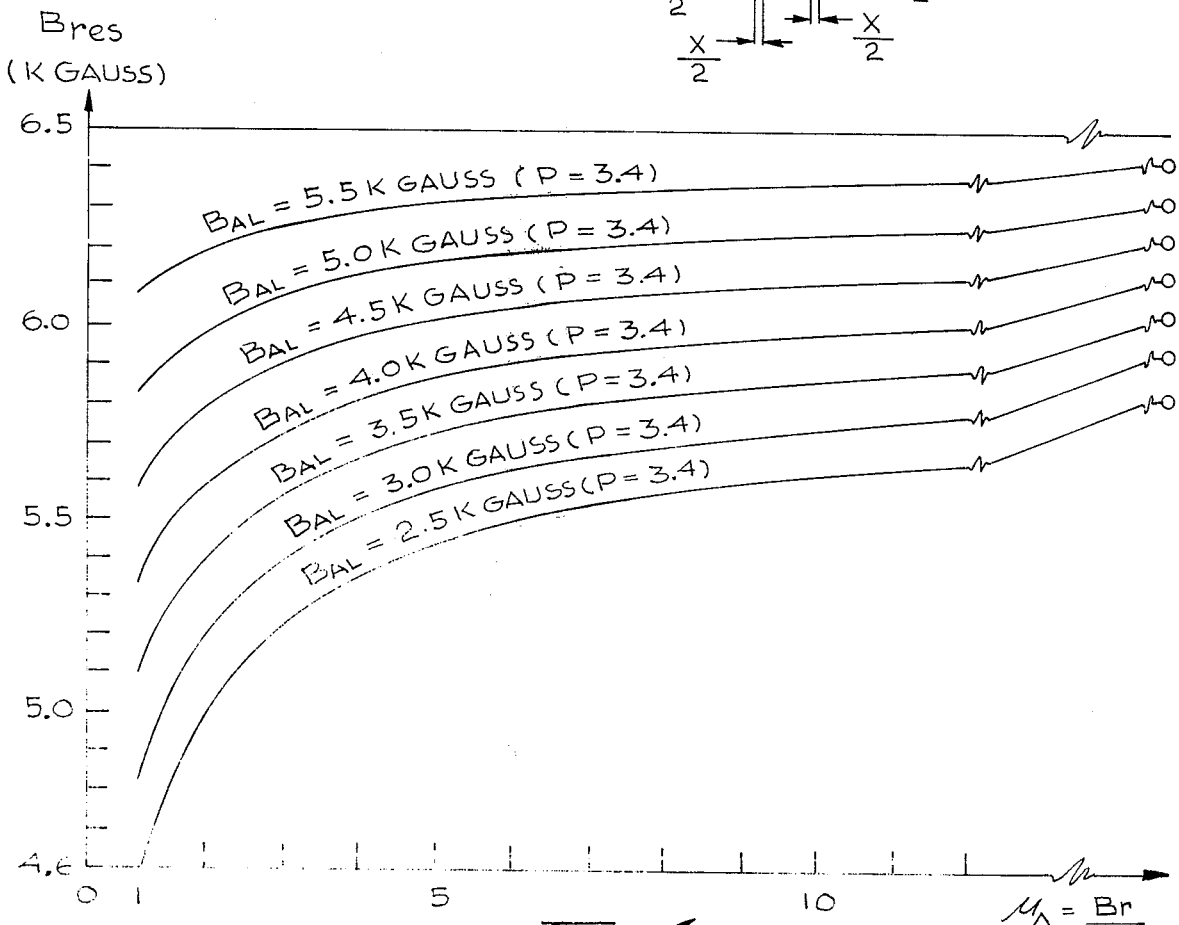
FIG. 6 is a graph illustrating the resultant gap flux density $B_{res}$ (K Gauss), in the configuration depicted in FIG. 5 as a function of the incremental permeability, $\mu\Delta = Br/Hc$, of different types of Alnico magnets interlaced with rare earth magnets of certain characteristics.

Using the abovementioned calculating method, the family of curves represented by FIG. 6 can be drawn. These curves show the resultant flux density $B_{res}$ as a function of incremental peremeability $\mu_{42}$ of different types of permanent magnets (typically Alnico) interlaced with rare earth magnets having a flux density of 6650 gauss at a permeance coefficient of P = 3.4, as typified by the samarium cobalt demagnetization curve of FIG. 3.

Rare earth magnets with an incremental permeability $\mu_{\Delta re}$ = 1.1 interlaced with magnets having the same incremental permeability, give a resultant flux density equal to the average of these magnets used separately. For instance, samarium cobalt magnets having 6650 gauss at P = 3.4 interlaced with MISCHMETAL magnets ($\mu_{\Delta mm}$=1.1) having 5500 gauss at P = 3.4 give a resultant flux density of (6650 + 5500)/2 = 6075 gauss (see FIG. 6).

In the same way, the resultant flux density of combinations of magnets with incremental permeabilities over 5 do not differ much from their average when used separately. For instance, it has been determined that Alnico 8 magnets ($\mu_\Delta$=7, B = 4000 gauss at P = 3.4) interlaced with Alnico 5-7 ($\mu_{\Delta b=162}$, B=2500 gauss at P = 3.4) give a resultant flux density of $B_{res}$ = 3385 gauss which is approximately equal to their average; i.e. (4000 + 2500)/2 = 3250 gauss.

Based on a combination of analytical and experimental evaluations, it has been determined that the highest rate of flux density gain (from the average of differing magnet materials) is achieved within the zone of incremental permeability 1.1 to 7 where one group of magnets (booster magnets) has an incremental permeability of, for example, $\mu_\Delta$= 1.1 and the other group has a higher incremental permeability, e.g. $\mu_\Delta$= 7. Furthermore, at a given flux density of the booster magnets, (e.g. rare earth) the rate of flux density gain increase with decreased flux density (at the same permeance) of the interlaced magnets (e.g. Alnico). Thus, with a samarium cobalt magnet having 6650 gauss at P = 3.4 (FIG. 6), an interlacing magnet with 5500 gauss at P = 3.4 and $\mu_\Delta$= 5 gives a resultant flux density of 6310 gauss or a gain of 235 gauss (3.9%) over the average flux density of the magnets (i.e. (6650 + 5500)/2 = 6075). An interlacing magnet with 2500 gauss at P = 3.4 and $\mu_\Delta$= 5 gives a resultant flux density of 5440 gauss or a gain of 5440−4575 = 856 gauss (191%).

Figure 7:
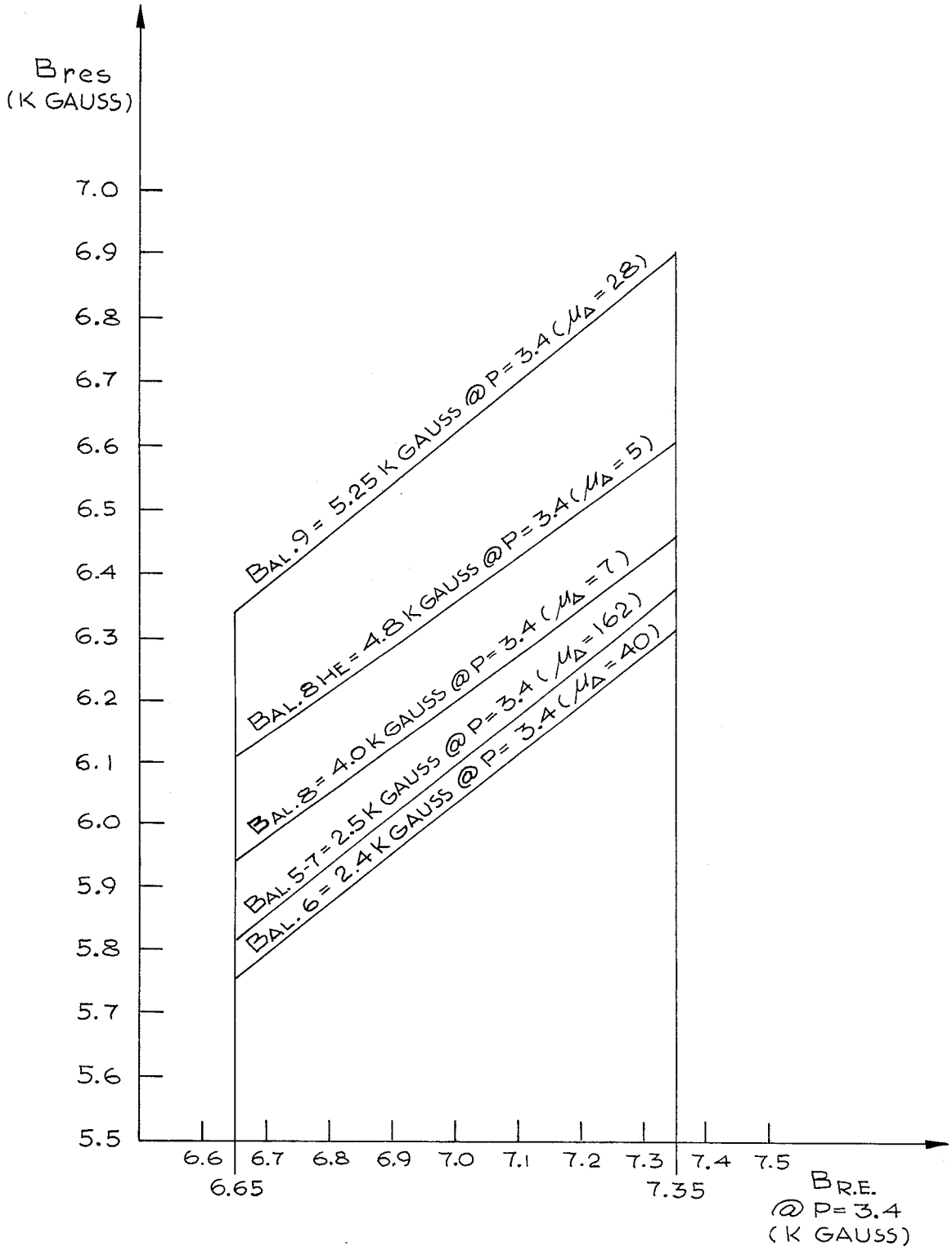
FIG. 7 is a graph illustrating the resultant gap flux density, $B_{res}$ (K Gauss), in the configuration depicted in FIG. 5 as a function of the flux density of rare earth magnets $B_{re}$ interlaced with different types of Alnico magnets.

FIG. 7 represents the resultant flux density $B_{res}$ as a function of rare earth type magnet flux density $B_{re}$ (at P = 3.4) interlaced with different known marks of permanent magnets (typically Alnico) where the incremental permeability "$\mu_\Delta$" corresponds to a point with a permeance coefficient of 3.4. Here $B_{res} = f(B_{re})$ are straight lines with slightly higher growth rates related to high incremental permeabilities. In the case of a booster rare earth magnet with a flux density (at P = 3.4) of $B_{re}$ = 7000 ± 350 gauss interlaced with Alnico 8 magnets with 4000 ± 200 gauss at P = 3.4, a resultant flux density of $B_{res}$ = 6200 ± 310 gauss is achieved, whereas the average flux density of these magnets used separately is $B_{av}$ = 5500 ± 275 gauss. Therefore, the total gain is 12.7%.

From the foregoing, it should now be apparent that a magnet assembly comprised of a combination of high energy, relatively low incremental permeability magnets, such as rare earth samarium cobalt magnets used in combination with either soft iron or less expensive lower energy higher incremental permeability magnets, such as Alnico, can yield an arrangement which is optimized for both gap flux density and energy product and thus magnet material utilization.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A magnet assembly comprising:

a plurality of substantially uniformly dimensioned magnetic members each having first and second pole faces and each being formed of substantially homogeneous material, said plurality of members being comprised of at least first and second groups having differing magnetic characteristics, said magnetic members of said first group comprising permanent magnets formed of a rare earth material and characterized by a maximum energy product in excess of 12 million gauss oersted;

said magnetic members of said second group being formed of soft iron; and means supporting said members in alignment with members of said first and second groups interleaved and uniformly spaced from one another to define a gap between each pair of opposed pole faces for receiving a flat movable coil.

2. A hammer assembly including:

a plurality of substantially uniformly dimensioned magnetic members each having first and second pole faces and each being formed of substantially homogeneous material;

means supporting a first set of said members in alignment along a first row uniformly spaced from one another to define a gap between each pair of opposed pole faces;

means supporting a second set of said members in alignment along a second row uniformly spaced from one another to define a gap between each pair of opposed pole faces, each such gap in said second row being uniquely aligned with one of said gaps in said first row;

magnetic bridging means coupling adjacent ends of said first and second rows to form a closed magnetic path through said first and second sets of magnetic members and said bridging means;

said plurality of magnetic members being comprised of first and second groups of magnetic members having different magnetic characteristics interleaved along said magnetic path, said first group of magnetic members comprising permanent magnets formed of rare earth material and characterized by a maximum energy product in excess of 12 million gauss oersted and oriented such that the pole faces thereof lie adjacent to said gaps; and

3. The assembly of claim 2 wherein said magnetic members of said second group are formed of soft iron.

4. The assembly of claim 2 wherein said magnetic members of said second group comprise permanent magnets.

5. The assembly of claim 4 wherein the particular dimensions of said magnetic members and said gaps define a certain magnetic circuit load line, and wherein the incremental permeability of said first group of permanent magnets defined by said load line is less than the incremental permeability of said second group of permanent magnets.

6. The assembly of claim 5 wherein said first group of permanent magnets has an incremental permeability approximately equal to 1.

7. A magnet assembly comprising:

a plurality of substantially uniformly dimensioned magnetic members each having first and second pole faces and each being formed of substantially homogeneous material, said plurality of members being comprised of at least first and second groups having differing magnetic characteristics, said magnetic members of said first group comprising permanent magnets formed of a rare earth material and characterized by a maximum energy product in excess of 12 million gauss oersted;

said magnetic members of said second group comprising permanent magnets formed of an aluminum-nickel-cobalt alloy; and means supporting said members in alignment with members of said first and second groups interleaved and uniformly spaced from one another to define a gap between each pair of opposed pole faces for receiving a flat movable coil.

8. The assembly of claim 7 wherein the particular dimensions of said magnetic members and said gaps define a certain magnetic circuit load line, and wherein the incremental permeability of said first group of permanent magnets defined by said load line is less than the incremental permeability of said second group of permanent magnets.

9. The assembly of claim 7 wherein said second group of permanent magnets has an incremental permeability greater than the incremental permeability of said first group.

* * * * *